US011459684B2

(12) United States Patent
Lee et al.

(10) Patent No.: US 11,459,684 B2
(45) Date of Patent: *Oct. 4, 2022

(54) WASHING MACHINE AND A CONTROL METHOD OF THE SAME

(71) Applicant: LG Electronics Inc., Seoul (KR)

(72) Inventors: Junkwan Lee, Seoul (KR); Sungjin Kim, Seoul (KR); Guntae Bae, Seoul (KR); Suman Bae, Seoul (KR); Dongsoo Choung, Seoul (KR)

(73) Assignee: LG Electronics Inc., Seoul (KR)

( * ) Notice: Subject to any disclaimer, the term of this patent is extended or adjusted under 35 U.S.C. 154(b) by 308 days.

This patent is subject to a terminal disclaimer.

(21) Appl. No.: 16/554,362

(22) Filed: Aug. 28, 2019

(65) Prior Publication Data

US 2019/0382935 A1 Dec. 19, 2019

(30) Foreign Application Priority Data

Aug. 5, 2019 (WO) ..... PCT/KR2019/009719

(51) Int. Cl.
*D06F 33/40* (2020.01)
*D06F 33/48* (2020.01)
(Continued)

(52) U.S. Cl.
CPC ..... *D06F 33/48* (2020.02); *D06F 23/02* (2013.01); *D06F 37/36* (2013.01); *D06F 33/40* (2020.02);
(Continued)

(58) Field of Classification Search
CPC ..... D06F 18/00; D06F 25/00; D06F 33/00; D06F 33/40; D06F 33/48; D06F 33/60;
(Continued)

(56) References Cited

U.S. PATENT DOCUMENTS

2020/0248357 A1* 8/2020 Koo ..... D06F 34/08

FOREIGN PATENT DOCUMENTS

JP 2019118404 7/2019
KR 1020140055262 5/2014
(Continued)

OTHER PUBLICATIONS

Machine Translation of Blauert et al., WO-2010072649-A1, Jul. 2010. (Year: 2010).*

(Continued)

*Primary Examiner* — David G Cormier
(74) *Attorney, Agent, or Firm* — Fish & Richardson P.C.

(57) ABSTRACT

A washing machine include: a case; a tub; a drum; a vibration sensor provided in the tub and configured to output a factor of a current vibration result for sensing a vibration value of the tub; a motor configured to drive the drum to process laundry; a motor control module configured to control a drum RPM to reflect a request RPM by controlling a current value of the motor and output a current vibration inducing factor; an AI module configured to receive inputs of the current vibration result factor and the vibration inducing factor and output a compensating variable for proactively deal with a future vibration result that is expected based on a current laundry distribution state, corresponding to a current laundry distribution state; and a processor configured to perform a dry-spin cycle through centrifugal power of the drum by compensating the request RPM by reflecting the compensating variable.

19 Claims, 10 Drawing Sheets

(51) Int. Cl.

| | |
|---|---|
| ***D06F 23/02*** | (2006.01) |
| ***D06F 37/36*** | (2006.01) |
| *D06F 34/16* | (2020.01) |
| *D06F 103/24* | (2020.01) |
| *D06F 103/26* | (2020.01) |
| *D06F 105/48* | (2020.01) |
| *D06F 34/32* | (2020.01) |

(52) U.S. Cl.
CPC ..... *D06F 34/16* (2020.02); *D06F 34/32* (2020.02); *D06F 2103/24* (2020.02); *D06F 2103/26* (2020.02); *D06F 2105/48* (2020.02)

(58) Field of Classification Search
CPC .... D06F 33/76; D06F 34/00; D06F 34/04–34; D06F 35/00–008; D06F 37/00; D06F 37/203; D06F 37/22; D06F 37/225; D06F 37/24; D06F 37/245; D06F 37/304; D06F 39/00; D06F 58/00; D06F 58/02; D06F 58/04; D06F 58/20; D06F 58/203; D06F 58/30; D06F 58/38; D06F 2101/00–20; D06F 2103/00–70; D06F 2105/50; D06F 2105/52–62; D06F 2201/10; D06F 2202/00–12; D06F 2204/00–10; D06F 2210/00; D06F 2212/00–06; D06F 2214/00; D06F 2216/00; D06F 2220/00; D06F 2222/00; D06F 2224/00; D06F 2226/00

See application file for complete search history.

(56) References Cited

FOREIGN PATENT DOCUMENTS

| | | | |
|---|---|---|---|
| KR | 1020190026517 | 3/2019 | |
| KR | 1020190076230 | 7/2019 | |
| KR | 1020190082693 | 7/2019 | |
| WO | WO-2010072649 A1 * | 7/2010 | ..... D06F 37/203 |

OTHER PUBLICATIONS

PCT International Search Report in International Application No. PCT/KR2019/009719, dated May 1, 2020, 20 pages (with English translation).

* cited by examiner

WASHING MACHINE AND A CONTROL METHOD OF THE SAME

CROSS-REFERENCE TO RELATED APPLICATION

This application claims priority to International Application No. PCT/KR2019/009719, having an International Filing Date of Aug. 5, 2019. The disclosure of the prior application is considered part of and is incorporated by reference in the disclosure of this application.

BACKGROUND OF THE DISCLOSURE

Field of the Disclosure

Embodiments of the present disclosure relate to a washing machine, more particularly, to a washing machine that may perform a dry-spin cycle effectively and a control method of the same.

Background of the Disclosure

A washing machine is an electric home appliance configured to wash clothing, using water, a washing detergent and a mechanical force of a drum. Generally, a washing process may be performed in an order of a wash cycle, a rinse cycle and a dry-spin cycle.

The dry-spin cycle means a process configured to remove water from clothing or laundry, using a centrifugal force generated by quickly rotating a drum holding the laundry.

Generally, in the dry-spin cycle, the drum RPM is 600 or more and may rise up to approximately 1400 RPM. In other words, the dry-spin cycle is configured to rotate the drum at a high rotation number so as to discharge water from the laundry through the centrifugal force. Accordingly, the laundry has to be dispersed in the drum uniformly so as to perform the dry-spin cycle effectively and smoothly, and stably rotated at a high speed in a state where vibration and noise are minimized. The over-vibration of the drum is likely to cause over-vibration of the washing machine and even damage to the drum or tub and the washing machine. Accordingly, various spinning algorithms are suggested and applied to normally and effectively raise the drum RPM by a target RPM.

Such a spinning algorithm is implemented to perform laundry dispersion by raising the drum RPM up to a target RPM step by step and prevent a main-spinning from starting in an over-vibrating state.

Also, a conventional spinning algorithm includes a step of comparing a current vibration valve (UB) with a preset vibration value. In this instance, the preset vibration valve may be set so as to perform the spinning consistently and set as a value at which the consistent spinning is performed easily. In other words, when the current vibration value is corresponding to the preset vibration value, it may be determined that the drum is over-vibrating and the drum may be paused. After that, a main-spinning may start again. That is, that step may be the algorithm configured to deal with the over-vibration that is determined based on the comparison.

Accordingly, until entering into the main spinning, the spinning might be tried several times and even failed to be entered sometimes. Because of that, it might take a long time to perform the spinning and the spinning might not be performed.

FIG. 1 illustrates one example of a conventional spinning algorithm. For easy understanding, a main-spinning is successfully entered and ideally performed in a state where the vibration caused by the eccentricity is minimized.

Until the main-spinning is performed upon reaching a target spinning RPM, the entering process into the main-spinning is tried at a middle RPM several times. Approximately two or three middle RPM values may be provided. FIG. 1 shows that three middle RPM values (e.g., 60 RPM, 108 RPM and 350 RPM) are provided. As one example, 1160 RPM is applied as the target RPM.

Once the dry-spin cycle starts, a tumbling drive is repeated several times to perform the laundry distribution. As shown in FIG. 1, the tumbling drive may be performed in 'a' section several times.

Upon the completion of the tumbling drive, a trial to enter into the main-spinning may be performed.

A first middle RPM may be equal to the tumbling RPM or a little bit higher. In other words, the drum is accelerated to a first middle RPM (e.g., about 60 RPM) in a state where the drum is paused (b section or a first acceleration step), and then consistently rotated at a second middle RPM for a preset time period (c section). In this instance, the tumbling RPM may mean a predetermined drum RPM at which the laundry is lifted and dropped repeatedly along the rotation of the drum. During the operation at the first middle RPM, a vibration value may be measured. When the measured value is less than a threshold vibration, the drum RPM may be accelerated to a second middle RPM (e.g., about 108 RPM) (d section or a second acceleration step). When the measured value is the threshold vibration value or more, the drum rotation may be paused and the main-spinning may be tried again. That is, the tumbling in a section or b section may re-start.

Meanwhile, once the drum is rotated at a spin RPM, the laundry may be in close contact with an inner circumferential surface of the drum enough not to perform the laundry distribution. Once RPM rises higher upon entering the spin RPM, the laundry may contact with the inner circumferential surface of the drum more closely. Accordingly, the laundry distribution may be performed in the section where the drum RPM is accelerated to the first middle RPM (b section) or the section of the tumbling RPM (c section). Alternatively, the laundry distribution may be performed in the section where the drum RPM is accelerated from the first middle RPM to the second middle RPM (d section). The laundry distribution may not be performed substantially in the next sections (e through i sections).

Accordingly, the laundry distribution has to be performed uniformly to enter into the main-spinning. Specifically, it is impossible to figure out whether the laundry distribution is performed effectively and the laundry distribution has to be performed repeatedly and uniformly upon failing to enter into the main-spinning.

The second middle RPM may be approximately the spin RPM. In this instance, the spin RPM may mean the drum RPM at which the laundry is integrally rotated with the drum, in close contact with the inner surface of the drum. Even when the drum RPM rises higher, the spin drive may be performed. Accordingly, the second middle RPM may mean the drum RPM that is a little bit higher than a critical RPM set to perform the spin drive.

Similarly, the drum rotation may be consistently performed at the second middle RPM for a preset time period (e section). Even in this section, the measured vibration value may be compared with the threshold vibration value and the drum rotation may be then paused or the entering into main-spinning may be then tried based on the result of the comparison as mentioned above.

When the vibration is less than an allowable limit during the second middle RPM operation, the drum rotation may be accelerated to a third middle RPM (f section, a third acceleration step). The third middle RPM may mean the drum RPM that is higher than a natural frequency of vibration and it may be about 350 RPM. Generally, the minimum spinning target RPM provided in the washing machine may be approximately 600~800 RPM. As the spin RPM is about 100 RPM, the third RPM may be a predetermined RPM from a spin drive critical RPM and the minimum spinning target RPM.

When the vibration is less than an allowable limit in the RPM acceleration section where the drum RPM is accelerated to the third middle RPM, the drum RPM may be accelerated to perform the operation at a target RPM. Of course, if excessive vibration is generated, the drum rotation may be paused.

The drum operation may be consistently performed at the third middle RPM (g section) and the drum rotation may be accelerated to a main-spinning RPM (h section or a fourth acceleration step). After that, the main-spinning (i section) may be performed. In this instance, g section may mean a stable spin section. Unless over-vibration is sensed in such a stable spinning section, the drum RPM may be accelerated to the main-spinning RPM and the main-spinning may be performed at the main-spinning RPM.

Such multistep spinning sections may be performed so as to reduce vibration by reducing eccentricity until the drum RPM reaches the main-spinning RPM. In other words, they may be performed so as to effectively perform the main-spinning at the main-spinning RPM without over-vibration. Also, the duration in each of the multistep spinning sections may be preset. Specifically, the duration time of the constant-speed RPM or acceleration-speed RPM is generally preset.

As mentioned above, the conventional spinning algorithm may fail to enter into the main-spinning and re-try to enter into the main-spinning. Accordingly, the main-spinning actuation performed in the over-vibration may be prevented. However, if the over-vibration occurs while trying to enter into the main-spinning, the operation has to be performed until the over-vibration occurs. Because of that, it can be said that the time taken until the over-vibration occurs is the time taken, regardless of the main-spinning. The time taken by the spinning cannot but increase accordingly. Such the over-vibration frequently occurs during the middle RPM drive such that it may be more likely to cause noise and shocks that will be applied to the washing machine. Also, an average vibration value has to rise in the overall spin cycle, which is likely to cause the deterioration of the washing machine durability.

Specifically, the drum rotation is paused only upon the occurrence of the over-vibration and the laundry distribution may be then performed. After that, the main-spinning may be re-tried. If the failure in entering into the main-spinning is repeated, the main-spinning might not be performed at last.

Meanwhile, it is possible to tray to lower a threshold vibration value that is preset to determine the failure in entering into the main-spinning. In this instance, the drum rotation may be paused before the occurrence of over-vibration. However, the failure might occur more frequently at this time and it is more likely to fail to enter into the main-spinning finally. In other words, the efforts in reducing the over-vibration might result in the decrease of the main-spinning success rate and the increase of the main-spinning duration time.

Accordingly, it is necessary to search inventions that may effectively achieve goals of final spinning success-rate increase, spinning duration time decrease and over-vibration prevention. In other words, it may be needed to simultaneously achieve those goals that might be contradictory to each other.

In the conventional spinning algorithm, the laundry distribution may be performed in a preset section for a preset time period such that it may not be easy to actively figure out whether the laundry distribution is effectively performed. Specifically, even unless proper laundry distribution is performed, the entry into the main-spinning will be tried and the failure to enter into the main-spinning is likely to occur frequently.

Accordingly, there are needs for new inventions or techniques that may achieve goals of increase of the final spinning success-rate, decrease of spinning time consumption and over-vibration prevention effectively by efficient performance of laundry distribution.

SUMMARY OF THE DISCLOSURE

Accordingly, an object of the present invention is to address the above-noted and other problems.

Another object of the present invention is to provide a washing machine that may expect over-vibration occurrence effectively and accurately before the occurrence and deal with the over-vibration, and a control method of the same.

A further object of the present invention is to provide a washing machine that may remarkably reduce the vibration and spinning duration time by reducing RPM before over-vibration occurs, and a control method of the same.

A still further object of the present invention is to provide a washing machine that may lower an average vibration value or the maximum vibration value during the spinning effectively, and a control method of the same.

A still further object of the present invention is to provide a washing machine that may raise spinning performance by performing active laundry distribution, and a control method of the same. Accordingly, the washing machine and the control method of the same may realize the increase of the main-spinning success-rate, the over-vibration prevention and the spinning duration time decrease.

A still further object of the present invention is to provide a washing machine that may perform the decrease of the spinning duration and the effective laundry distribution by combining repeated laundry distribution sections into one section which may be facilitated by specifying the RPM acceleration section in which the active laundry distribution is performed.

Embodiments of the present disclosure may provide a washing machine comprising a case that defines an exterior design; a tub provided in the case and configured to hold wash water; a drum rotatably mounted in the tub and configured to accommodate a processing object; a vibration sensor provided in the tub and configured to output a factor of a current vibration result for sensing a vibration value of the tub; a motor configured to drive the drum to process the laundry; a motor control module configured to control a current drum RPM to reflect a request RPM by controlling a current value applied to the motor and output a current vibration inducing factor; an AI module configured to receive inputs of the current vibration result factor and the vibration inducing factor and output a compensating variable for proactively deal with a future vibration result that is expected based on a current laundry distribution state, in a dry-spin cycle; and a processor configured to perform a dry-spin cycle through a centrifugal power of the drum by compensating the request RPM by reflecting the compensating variable in a vibration expectation section.

The preset control logic may be defined as changes of the request RPM when time passes to perform a main-spinning at a main-spinning RPM by accelerating a drum rotation from a start of the drum rotation to a main-spinning RPM.

The preset control logic may be configured to perform only RPM maintenance or rise upon starting drum rotation unless the compensating variable is applied and pause the drum after the main-spin.

A re-start of the preset control logic may be defined to pause the drum and re-perform the preset control logic.

The vibration expectation section may be set as some of a RPM band in the preset control logic.

The vibration expectation section comprises a middle spin RPM acceleration section in which the drum RPM is accelerated to a middle RPM that is lower than a main-spinning RPM from a spin RPM.

The vibration expectation section may comprise a maintenance section in which the drum RPM is consistently maintained at the spin RPM right before the middle spin RPM acceleration section.

The vibration expectation section may comprise a maintenance section in which the drum RPM is consistently maintained at the middle-spin RPM after the middle spin RPM acceleration section.

The spin RPM may be set higher than a critical RPM set to integrally rotate all of the laundry with the drum, while excluding a tumbling for lifting and dropping the laundry during the rotation of the drum.

The spin RPM may be set as approximately 108 RPM.

The AI module may be configured to input a current vibration result factor and a vibration inducting factor and output a compensating variable for a main-spinning entry success rate.

The output of the compensating variable may be consistently performed at preset time intervals.

A compensating variable improved with respect to the same inputs may be output through the learning of the AI module.

The learning of the AI module may be performed through a deep neural network and deep learning.

The AI module may output respective compensating variables by performing different learnings for the same input.

The learning may comprise classification learning and regression learning.

A value output by the learning result may be compared with a critical value, and it is determined whether to consistently perform or restart the dry-spin cycle preset control logic.

The critical value may be different according to a RPM band of the vibration expectation section.

As a RPM band becomes high in the vibration expectation section, a more strict critical value may be applied to allow no over-vibration when the RPM band is lower.

The washing machine may further comprise a gyro-sensor configured to sense and output a 3-axis linear displacement and a 3-axis angular displacement that are generated by the vibration that occurs along the rotation of the drum, wherein the vibration result factor may include an output value from the gyro-sensor.

Embodiments of the present disclosure may also provide a control method of a washing machine comprising: a first acceleration step of accelerating a drum RPM to a tumbling RPM upon a dry-spin cycle starting; a tumbling maintenance step of consistently driving the drum at the tumbling RPM after the first acceleration step; a second acceleration step of accelerating the drum RPM to a spin RPM continuously after the tumbling maintenance step; a spin maintenance step of consistently maintaining the spin RPM after the second acceleration step; a middle spin RPM acceleration step of continuously accelerating to a middle spin RPM that is lower than the main-spinning RPM after the spin maintenance step; and a main-spinning step of performing spin by accelerating the drum RPM to a final target RPM after the spin maintenance step, wherein during the middle spin RPM acceleration step, the consistent performance of the preset control logic of the dry-spin cycle or the restart of the preset control logic after pausing the drum may be performed based on the result of the output to output a compensating variable for proactively deal with a future vibration result that is expected based on a current laundry distribution state after receiving inputs of the current vibration result factor and the vibration inducing factor.

Embodiments of the present disclosure may also provide a washing machine comprising a case that defines an exterior design; a tub provided in the case and configured to hold wash water; a drum rotatably mounted in the tub and configured to accommodate a processing object; a vibration sensor provided in the tub and configured to output a factor of a current vibration result for sensing a vibration value of the tub; a motor configured to drive the drum to process the laundry; a motor control module configured to control a current drum RPM to reflect a request RPM by controlling a current value applied to the motor and output a current vibration inducing factor; an AI module configured to receive inputs of the current vibration result factor and the vibration inducing factor and output a compensating variable for proactively deal with a future vibration result that is expected based on a current laundry distribution state, corresponding to a current laundry distribution state; and a processor configured to perform a dry-spin cycle through a centrifugal power of the drum by compensating the request RPM by reflecting the compensating variable.

The dry-spin cycle may comprise an acceleration section in which the drum RPM is accelerated from a tumbling RPM to a spin RPM for the laundry distribution, and the request RPM compensation control may be performed in the acceleration section.

The dry-spin cycle may comprise a tumbling maintenance section in which the drum rotation is maintained at the tumbling RPM right before the acceleration section is performed; and a spin RPM maintenance section in which the drum rotation may be accelerated to the spin RPM after the acceleration section.

It may be excluded in the dry-spin cycle that the tumbling drive and the drum pausing are repeatedly performed for the laundry distribution after the dry-spin cycle starts.

In the dry-spin cycle, the tumbling maintenance section may start by the drum rotation reaching the tumbling RPM upon the dry-spin cycle starting.

The tumbling RPM may be preset as about 60 RPM and the spin RPM is preset as about 108 RPM.

The request RPM compensation control may be performed only until the drum rotation reaches a predetermined RPM that is lower than a final target RPM of the acceleration section.

The request RPM compensation control may be performed only until the drum rotation reaches about 90 RPM in the acceleration section.

The compensating variable may be corresponding to one of current RPM maintenance, acceleration and deceleration.

An absolute value for the acceleration or deceleration maximum value by the compensating variable may be set larger than the absolute value for the basic acceleration maximum value in the acceleration section.

The output of the compensating variable may be consistently performed at preset time intervals.

The request RPM compensation control may be performed to control the drum RPM in real time.

The AI module may be configured to learn whether over-vibration occurs based on the current vibration result factor, the vibration inducing factor and the request RPM compensation control.

A compensating variable improved for the same input may be evolved and output through the learning of the AI module.

The learning of the AI module may be performed through a deep neural network and deep learning.

The washing machine may further comprise a communication module configured to be communication-connected with an external server so as to update the learning result of the AI module via the external server.

The washing machine may further comprise a gyro-sensor configured to sense and output a 3-axis linear displacement and a 3-axis angular displacement that are generated by the vibration that occurs along the rotation of the drum, wherein the vibration result factor may include an output value from the gyro-sensor.

The gyro-sensor may be provided in an outer area of the tub.

The gyro-sensor may be provided in an upper end of the tub.

The gyro-sensor may be located in a horizontal center with respect to a front area of the tub.

Embodiments of the present disclosure may also provide a control method of a washing machine comprising a first acceleration step of accelerating a drum RPM to a tumbling RPM upon a dry-spin cycle starting; a tumbling maintenance step of consistently driving the drum at the tumbling RPM after the first acceleration step; a second acceleration step of accelerating the drum RPM to a spin RPM continuously after the tumbling maintenance step; a spin maintenance step of consistently maintaining the spin RPM after the second acceleration step; and a main-spinning step of performing spin by accelerating the drum RPM to a final target RPM after the spin maintenance step, wherein the second acceleration step compensation-controls the request RPM based on the result of the output to output a compensating variable for proactively deal with a future vibration result that is expected based on a current laundry distribution state after receiving inputs of the current vibration result factor and the vibration inducing factor.

According to embodiments of the present disclosure, the washing machine has following effects.

First, the washing machine and the control method of the same may expect over-vibration occurrence effectively and accurately before the occurrence and deal with the over-vibration.

Furthermore, the washing machine and the control method of the same may remarkably reduce the vibration and spinning duration time by reducing RPM before over-vibration occurs.

Still further, the washing machine and the control method of the same may lower an average vibration value or the maximum vibration value during the spinning effectively.

Still further, the washing machine and the control method of the same may raise spinning performance by performing active laundry distribution. Accordingly, the washing machine and the control method of the same may realize the increase of the main-spinning success-rate, the over-vibration prevention and the spinning duration time decrease.

Still further, the washing machine and the control method of the same may perform the decrease of the spinning duration and the effective laundry distribution by combining repeated laundry distribution sections into one section which may be facilitated by specifying the RPM acceleration section in which the active laundry distribution is performed.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Referring to the accompanying drawings, a washing machine and a control method of the same according to exemplary embodiments of the present disclosure will be described in detail.

Hereinafter, referring to FIGS. 1 and 2, a washing machine according to one embodiment of the present invention will be described in detail.

Figure 1:
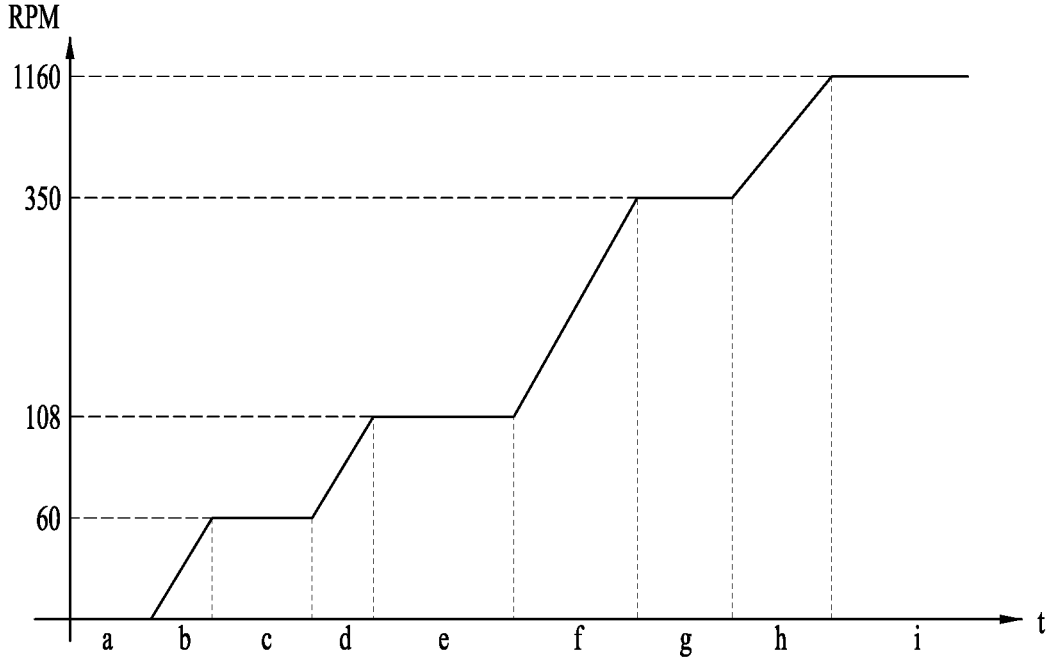
FIG. 1 is a graph illustrating RPM changes in a conventional spinning method.
Figure 2:
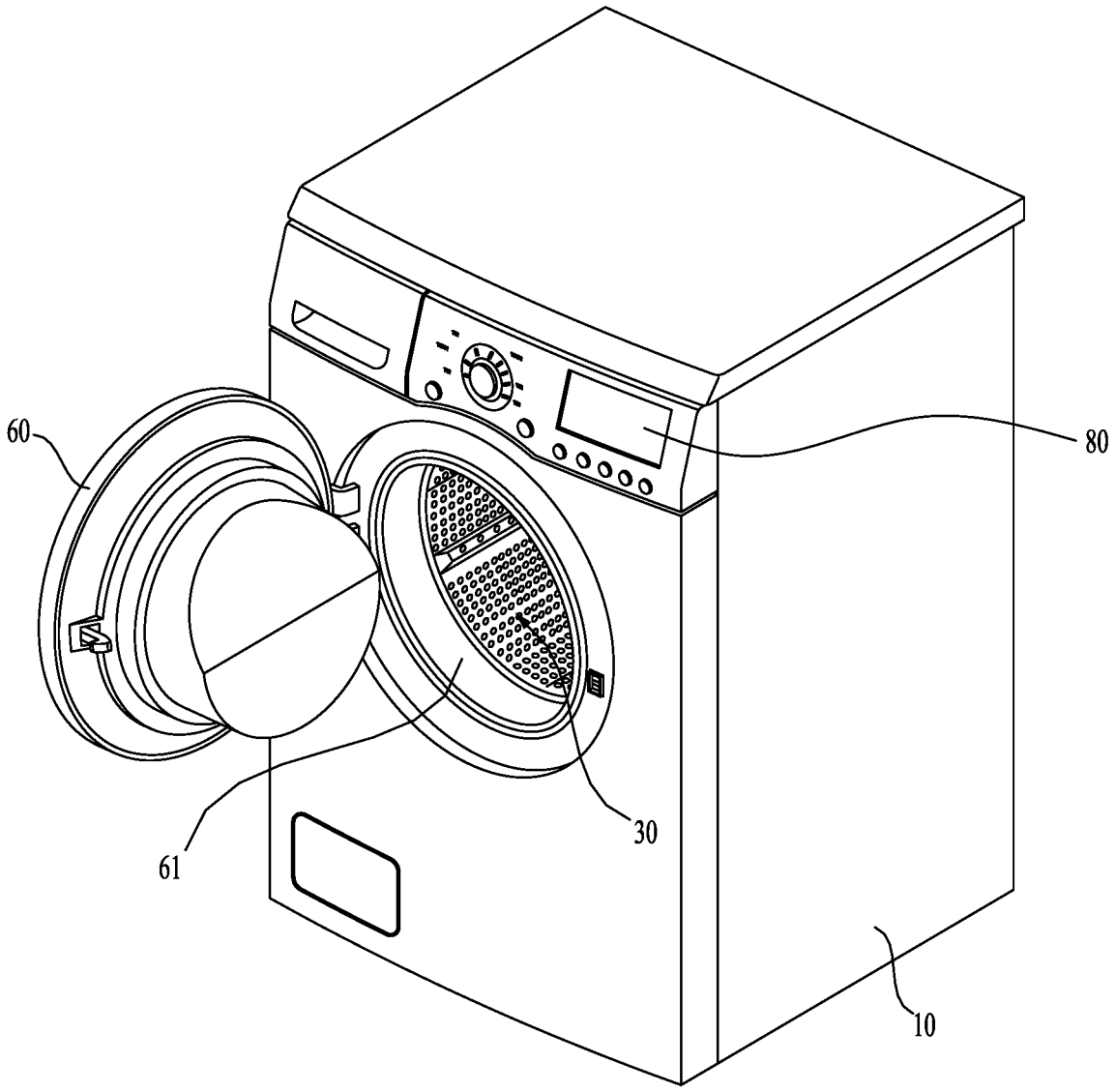
FIG. 2 is a perspective diagram illustrating an exterior design of a washing machine according to one embodiment of the present invention.

FIG. 1 is a graph illustrating RPM changes in a conventional spinning method. FIG. 2 is a perspective diagram illustrating an exterior design of a washing machine according to one embodiment of the present invention.

The washing machine according to this embodiment may include a cabinet 10 defining an exterior design; a tub 20; a drum 30; and a door 60 provided to load or unload clothing as a treating object into or from the drum by opening and closing the drum 30. Accordingly, the door may open and close a laundry opening 61 formed in the cabinet 10.

The tub 20 may be provided in the cabinet 10 and configured to accommodate the drum 30. The drum 30 may be rotatably mounted in the tub 20 and configured to accommodate laundry. An opening is formed in a front side of the drum 30 and the laundry is introduced into the drum 30 via the opening.

A through-hole 30*h* may be formed in a circumferential surface of the drum 30 to facilitate communication of air and wash water between the tub 20 and the drum 30.

Figure 3:
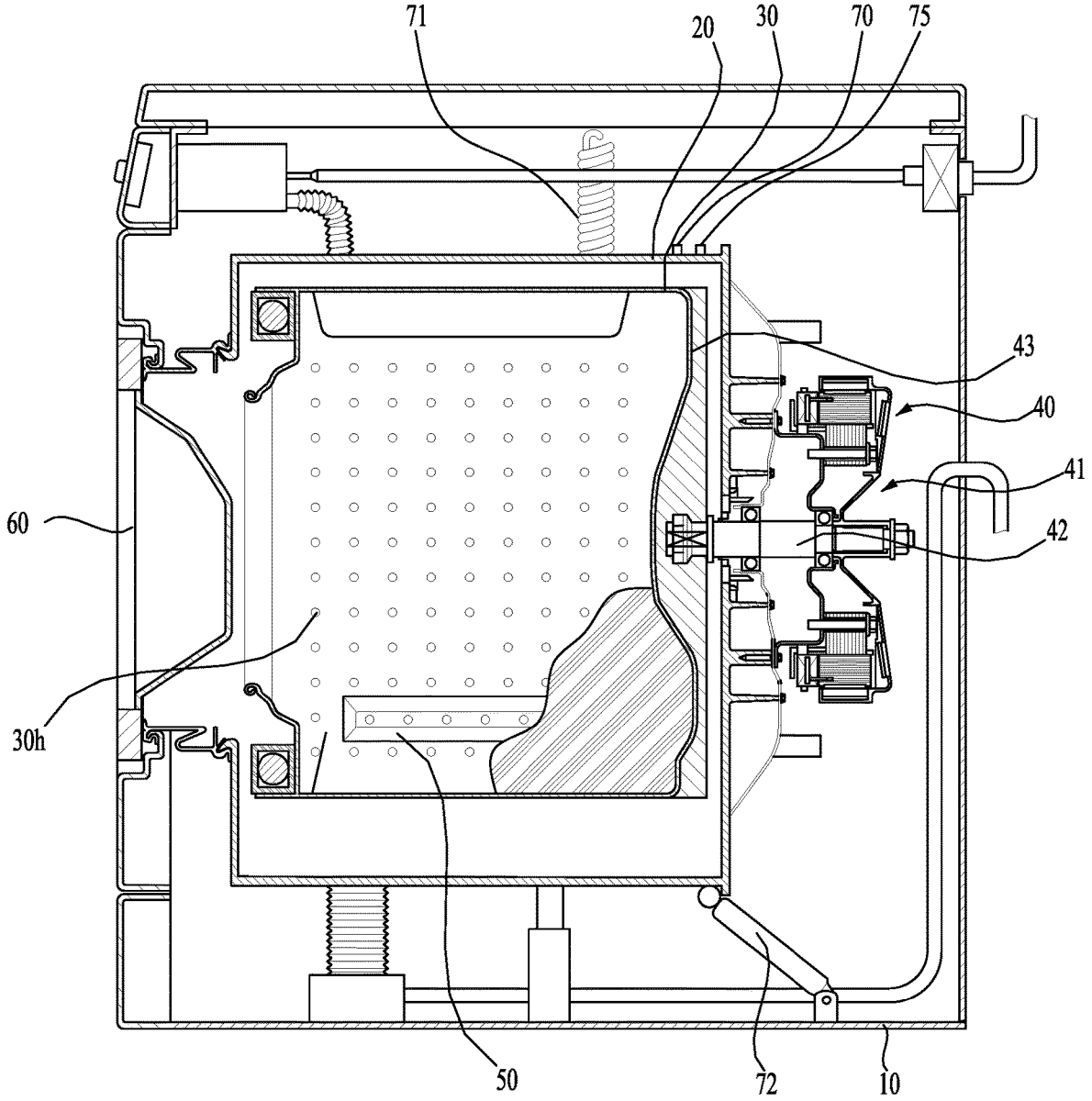
FIG. 3 is a sectional diagram illustrating the washing machine according to one embodiment.
Figure 4:
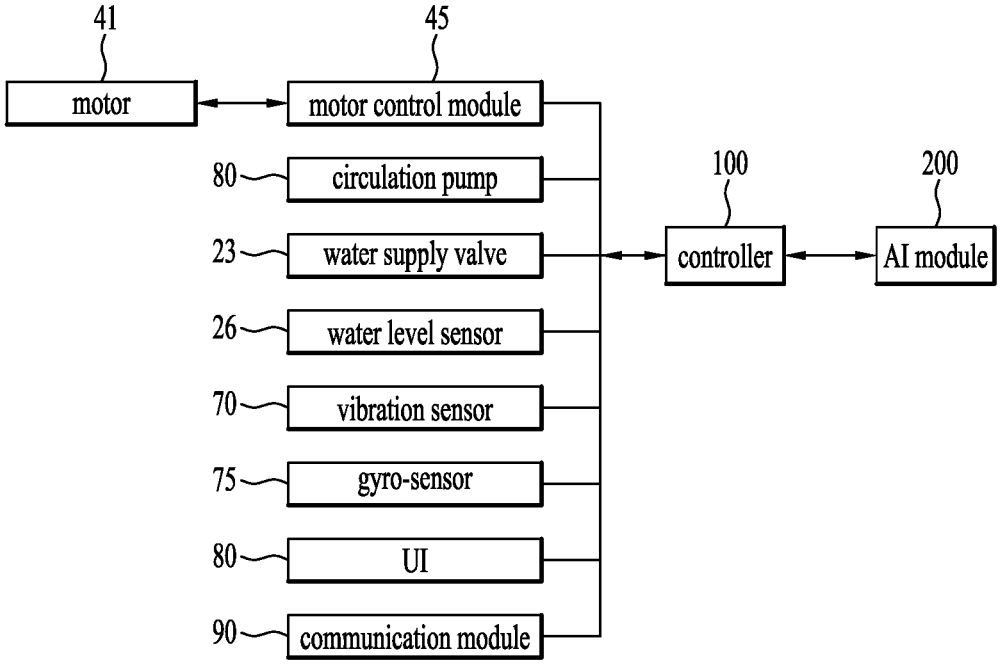
FIG. 4 is a block view of the washing machine according to one embodiment.

The tub 20 and the drum 30 may be formed in a cylinder shape. Accordingly, inner and outer circumferential surfaces of the tub and the drum 30 may be substantially formed in a cylinder shape. FIG. 3 illustrates a washing machine in which the drum 30 is rotatable on a shaft parallel with the ground. Different from that, the washing machine may be a tilted type in which the drum 30 and the tub 20 may be tilted backwardly.

The washing machine may further include a drive unit 40 configured to rotate in the tub 20. The drive unit 40 may include a motor 41 and the motor 41 includes a stator and a rotor. The rotor may be connected with the shaft 42 to rotate the drum 30 in the tub 20.

The drive unit 40 may include a spider 43. The spider 43 is provided to connect the drum 30 and the shaft 42 with each other and it is said that the spider 43 is configured to transmit a rotation power of the shaft 42 to the drum 30 uniformly and stably.

The spider 43 may be coupled to the drum 30 in a state of being partially inserted in a rear wall of the drum. For that, the rear wall of the drum 30 is recessed towards the inside of the drum. The spider 43 may be inserted in the drum 30 at a rotation center of the drum 30.

A liter 50 may be provided in the drum 30. A plurality of lifters 50 may be provided along a circumferential direction of the drum 30. The lifters 50 may be configured to agitate the laundry. As one example, the lifters 50 may raise the laundry upon the drum 30 being rotated.

The raised laundry may be separated from the lifters 50 by the gravity and then dropped to a bottom, such that the laundry may be washed by a shock caused by the dropping. In this instance, the agitation of the laundry may enhance drying efficiency. The laundry may be distributed in the drum 30 uniformly. Accordingly, the lifters 50 may extend from a rear end to a front end of the drum 30.

The washing machine according to the present embodiment may include user interface (UI, 80). The UI may include various buttons or a rotary knob, especially, a display. A user is able to input information for treating the laundry via the UI. Also, the washing machine may provide the user with information about the laundry that is washed according to the user's input via the UI.

Especially, the display may be realized by a touch display and the touch display may display the user's input of information and information stored in the washing machine.

The display may display characters, numbers or images. Clock-based images, augmented reality images or animation which will be described later may be displayed on the display. Accordingly, the user is able to recognize the current laundry processing information and conditions of the washing machine intuitively.

Once the user selects a specific washing course through the UI 80, a control unit 100 may be implemented to perform washing according to the selected washing course.

First of all, a water supply valve 23 may be controlled to supply wash water to the tub and supply a predetermined amount of wash water to the tub by using a water level sensor 26.

Upon completing the water supply, the control unit may drive the motor 41 to perform the washing. In other words, upon rotating the drum 30, the washing may be performed by using a washing detergent, wash water and a mechanical power of the drum 30. At this time, a circulation pump 80 may be actuated to enhance washing efficiency. The circulation pump 80 may be configured to pump the wash water from the bottom of the tub and re-supply the wash water to an upper area of the drum. The washing may not be performed in a state of being submerged in the wash water in the drum such that the washing efficiency may be enhanced by supplying the wash water to the laundry more effectively.

The washing machine according to the present embodiment may include a communication module 90. The communication module 90 may be configured to communication-connect the washing machine to an external server so as to transceive information. The washing machine may transceive information with the user's terminal via the external server.

As one example, the user is able to input a remote control command via the external terminal. Such a remote control command may be transmitted to the washing machine via the server to control the washing machine remotely.

Once the user inputs a command for the washing machine remotely, the washing machine may transmit information about a current state to the server, while performing a washing process for the laundry. The server may transmit the information to the user's external terminal. Accordingly, the user is able to recognize the current laundry processing information through the external terminal.

In addition, the washing machine may update a software or firmware through the communication module 90 according to the transmitted information of the server. The washing machine according to one embodiment may perform learning for performing active laundry distribution, which will be described later. The result of the learning may be expanded and then shared or updated by the server, of which details will be described later.

In this embodiment, the washing machine may include a vibration sensor 70 shown in FIG. 3.

The shaft 42 configured to rotate the drum 30 may be connected with the drum mounted in the tub upon penetrating the tub 2 such that the vibration of the drum can be transmitted to the tub. The vibration transmitted to the tub may be transmitted to the cabinet. As the drum is vibrating, the entire structure of the washing machine may be vibrating.

The washing machine may include a vibration damping device 71 and 52 to reduce the vibration transmitted to the cabinet via the tub. The vibration damping device may include a spring 71 and a damper 72.

However, the vibration damping effect achieved by using such the vibration damping device cannot be limited. When the drum is rotated at a high speed, a big vibration may be generated and the vibration cannot but be transmitted to the tub and the cabinet. Such over-vibration is likely to occur in a state where the laundry is eccentric in the drum upon failing to be distributed uniformly.

Accordingly, when the over-vibration is generated, a vibration sensor or UB sensor 70 may be provided to sense the over-vibration. The vibration sensor may sense the altitude of vibration in a normal state of the washing machine (or a state where the tub is paused). The vibration sensor 70 may be provided in an upper end of the tub to reduce the optimal vibration amount of the tub. Especially, it may be an upper rear end or an upper front end of the tub.

Meanwhile, the washing machine according to the embodiment may include an acceleration sensor or a gyro-sensor 75. The gyro-sensor 75 may sense linear displacement or angle of three axes. Accordingly, the gyro-sensor may be called the 6-axis sensor. Acceleration changes may be calculated based one the linear displacement and angle displacement of each axis.

The gyro-sensor 75 may effectively sense and calculate the result of the vibration. Vibration physically occurs in 3-dimensionally such that all-direction vibration displacements may be sensed by the 6-axis sensor. In other words, the entire vibration occurrence result may be sensed and calculated.

To effectively sense the result of the tub vibration, the gyro-sensor 75 may be provided in an upper end of the tub, specifically, an uppermost area of the tub. Also, to effectively sense the displacement, the gyro-sensor 75 may be provided near the rear surface or front end of the tub.

In this instance, the gyro-sensor 75 may be one of vibration sensors. As the gyro-sensor 75 is applied, the vibration sensor 70 mentioned above may be omitted. That is because the vibration sensor 70 is configured to output one of the displacements (e.g., a vertical linear displacement).

The vibration sensor 70 is able to sense a vibration value based on a difference between installation positions with respect to the gyro-sensor. Alternatively, a plurality of vibration sensors 70 may be installed in front and rear ends of the tub so as to precisely sense the vibration value by using a phase difference.

The spinning means a process for centrifugally separate moisture from the laundry by rotating the drum at a high speed. Accordingly, it is preferred that a high speed spinning is performed after the laundry is distributed in the drum uniformly. In other words, before the high speed spinning, the movement of the clothing has to be uniformly dispersed in the drum and the high speed spinning may be performed after that. That technical feature is important in terms of vibration and noise prevention and system protection as well as effective spinning. Unless the laundry is uniformly distributed, the entry into the high speed spinning is likely to be delayed or even failed. Accordingly, the proper spinning may not be performed and the total washing time is likely to be lengthened. In addition, an incomplete spinning is performed only to deteriorate the spinning effect and user satisfaction.

Because of that, it is very important to determine whether the laundry is properly distributed before the high speed spinning and perform the high speed spinning after that. However, as mentioned above, the conventional spinning algorithm may is configured to repeat the tumbling acceleration section (b section), the tumbling section (c section) and the spin acceleration section (d section) that are the preset logic, if necessary.

Specifically, the laundry distribution is performed in the conventional washing machine only after simply determining only the vibration or eccentricity of the drum (e.g., UB gained by using the vibration sensor). In other words, upon over-vibration occurring, the laundry distribution is performed and such repetition of such laundry distribution is performed until the over-vibration is absorbed. Accordingly, it might be difficult to determine whether such the laundry distribution is effectively performed. The failure in the entry into the spinning and the frequency of spinning delay have to rise relatively such that spinning quality can deteriorate.

However, according to one embodiment of the present invention, active and positive laundry distribution may be performed, not the repeated and passive laundry distribution, which will be described in detail later.

The washing machine according to the embodiment may include a motor control module 45 configured to control the drive of the motor. The motor control module 45 may control a current value and a voltage value that are applied to the motor rotate the motor at a target RPM so as to rotate the drum.

The motor control module 45 may be configured to directly control the drive of the motor according to the control of the control unit (100, the processor or main processor). The motor control module 45 may calculate the current RPM of the motor and the current value applied to the motor based on the feedback control. In other words, the motor control module 45 may output the current RPM of the drum and the current value applied to the motor.

The control unit 100 may transmit a target RPM of the drum according to a control sequence, in other words, a request RPM or a command RPM to the motor control module 45. The motor control module 45 may control the current RPM to follow the request RPM. In this time, a plurality of spinning sections may be divided according to the request RPM as shown in FIG. 1.

Accordingly, the control unit may recognize a current request RPM and then recognize the current RPM of the drum and the current value applied to the motor based on the value transmitted from the motor control module 45.

In an ideal environment with no vibration, the current value applied to the motor, the request RPM and the current RPM may be matched identically. In other words, an applied current value may be specified corresponding to a specific request RPM. Once such a specific current value is applied, the current RPM may become a specific request RPM. Again, as shown in FIG. 1, the request RPM and the current RPM are substantially equal to each other.

However, vibration has to occur inevitably. As the vibration value is larger, a difference among the request RPM, the applied current value and the current has to rise. Of course, such a difference may be minimized by the feedback control. However, it can be said that such the feedback control is different from the vibration removal or over-vibration prevention. In other words, the drum rotation has to be controlled to prevent the over-vibration while the feedback control is performed.

Along with the rotation of the drum, vibration inevitably occurs. Especially, as the laundry loaded in the drum is more eccentric, a stronger vibration occurs. As the rotation number of the drum rises with the same eccentricity, a stronger vibration might occur.

Accordingly, the precondition of the vibration occurrence is the drum rotation. A factor for rotating the drum and determining the drum RPM may be the current value applied to the motor. Also, a corresponding value to the current value is the request RPM and the current RPM is variable in communication with vibration.

As a result, the current value, the request RPM and the current RPM may be the vibration inducing factors.

Meanwhile, once vibration occurs, the vibration value may be sensed by the vibration sensor. In other words, a UB value may be a vibration result factor that is sensed by the vibration sensor. Also, the vibration may be caused by the 3-axis linear displacement and 3-axis angle displacement such that the six values sensed by the gyro-sensor may be vibration result factors as well.

The control unit 100 may perform the active laundry distribution or the active spinning algorithm based on the vibration inducing factor and the vibration result factors.

Specifically, the vibration inducing factor and the vibration result factors are set as the features and vibration may be expected in real time. Such expectation of vibration may be performed by an AI module 200.

Hereinafter, referring to FIG. 5, a control method of the washing machine according to one embodiment of the present invention will be described in detail. Especially, a spinning control method configured to perform the laundry distribution actively will be described in detail.

Figure 5:
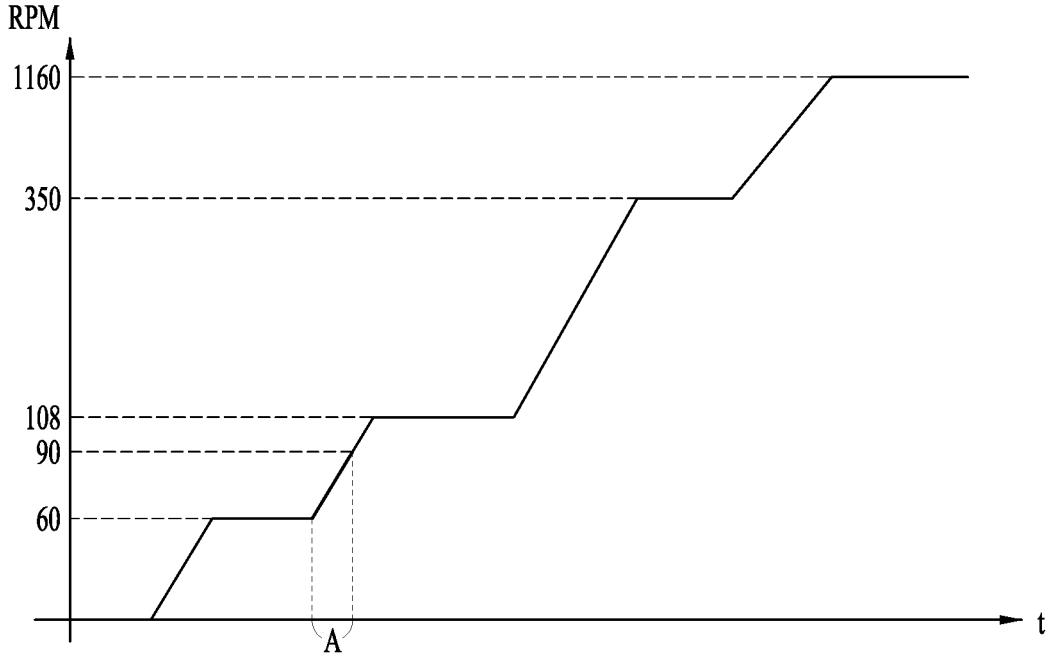
FIG. 5 is a graph illustrating one example of RPM changes and a request RPM compensation control section provided in a laundry distribution acceleration section according to one embodiment.

As shown in FIG. 5, the control method according to one embodiment may be similar to a conventional control method. This embodiment is characterized in that a section or step may be provided to compensate the request RPM by reflecting a compensating variable, which is different from the conventional control method.

Basically, in this embodiment may be provided a section in which the drum RPM is accelerated from a tumbling RPM to a spin RPM. Such a section may be equal to d section of the conventional spinning control method. A start or end RPM of d section may be different for every size or model of the product. However, such d section may be a section between the RPM at which complete tumbling is performed and another RPM at which complete spinning is performed. In other words, when performing d section, some of the laundry is lifted and dropped like the tumbling drive and some of the laundry is integrally rotated together with the drum like the spinning drive, in close contact with the drum. As the RPM rises in d section, a rate of the lifted and dropped laundry may decrease and a rate of the laundry integrally rotated together with the drum, in close contact with the drum may increase.

Such d section may be a laundry distribution acceleration section in the dry-spin cycle. That is because the laundry distribution can be effectively performed as flow characteristics of the laundry are variable because of the RPM characteristics in d section.

The conventional control spinning method may have such the laundry distribution acceleration section. However, simple acceleration is performed in the conventional laundry distribution acceleration section. The laundry distribution acceleration section may be the section in which the drum rotation is paused upon sensing over-vibration, the drum and only accelerated to a target RPM. Because of that, it might be difficult to perform the effective laundry distribution in the laundry distribution acceleration section. In addition, it might be difficult to figure out a laundry distribution state or whether proper laundry distribution is performed in the laundry distribution acceleration section. That is because the request RPM is set to linearly rise in the laundry distribution acceleration section.

According to this embodiment, more effective laundry distribution may be performed by actively controlling the request RPM in such the laundry distribution acceleration section. The active laundry distribution may be performed by figuring out the degree of the laundry distribution or whether the proper laundry distribution is performed in the laundry distribution acceleration section. In other words, it is determined in the laundry distribution acceleration section whether to increase or decrease or maintain the request RPM. The laundry distribution acceleration section may be performed by reflecting the result of the determination. Specifically, the conventional laundry distribution acceleration section is performed only for a preset time period, with a preset RPM increase slope. In contrast, the RPM increase slope is changed according to a laundry distribution state and the duration time of the laundry distribution acceleration section according to this embodiment may be changeable.

The positive compensating control for the request RPM may be performed by reflecting a compensating variable. The compensating variable may be a variable for determining whether to increase, decrease or maintain the drum RPM to the current request RPM. The RPM increase means acceleration and the RPM decrease means deceleration. The RPM maintaining means a constant speed. The compensating control may be performed by reflecting all of the three cases. Alternatively, it may be performed by reflecting only two cases of the acceleration and the maintaining or the acceleration and the deceleration. The RPM increase may mean that the current laundry distribution state is unlikely to cause over-vibration. In other words, it may mean that the laundry distribution state is relatively good. The RPM decrease may mean that the current laundry distribution state is likely to cause over-vibration. In other words, the laundry distribution state is relatively bad.

A processor may compensate a preset request RPM based on the compensating variable and transmit the compensated request RPM to the motor control module. The motor control module may control the drum rotation based on the compensated request RPM.

The compensating variable may be output via an AI module 200. The AI module 200 may receive and output an input of the current vibration result factor and the current vibration inducing factors to deal with an expected following vibration result corresponding to a current laundry distribution state. In other words, upon expecting the future vibration in a current state, the AI module may control the drum rotation in a direction which reduces the future vibration. Upon expecting no future vibration in the current state, it may control the current drum rotation control logic to be maintained or accelerated.

As one example, the compensating variables may be output as different values according to the laundry distribution state. The request RPM compensation control logic for each value may be preset. As one example, when the compensating value is near zero, the RPM is decelerated. When it is near 0.3, the RPM is maintained. When it is near 0.7, the RPM may be accelerated.

Specifically, as the compensating value rises, the current state is reflected and it becomes unlikely to cause the future over-vibration to occur. As the compensating value falls, the current state is reflected and it then becomes likely to cause the future over-vibration. Of course, the compensating variable may be output to have the reverse trend.

In this instance, it may be important to determine how the future over-vibration is likely to occur based on the current state. For that, in one embodiment of the present invention, the AI module may perform learning and output the result of such learning as the compensating variable.

As mentioned above, the current state may be figured out based on the current vibration factor and the vibration inducting factors. The compensating variable may be output by reflecting such the current state.

As mentioned above, the vibration inducing factors may be the actual RPM, the request RPM and the applied current value. In addition, the vibration result factor may be a gyro-sensor output value and a vibration sensor output value.

Such the factors may be input and the AI module may output the compensating variable based on the input factors. It is difficult to numerically calculate the relation between the factors and the compensating variable through learning.

The number of the factors may be determined as ten and a plurality of frames may be then generated. As one example, 40 frames may be generated. In other words, 10-dimensional data may be used as much as 40 frames. At this time, the number of the frames may be increased or decreased and the 40 frames may be generated in time-series.

Deep learning techniques optimized to model the multi-dimensional data are provided. Accordingly, such deep learning techniques are used in effectively outputting the compensating variable for the multi-dimensional input factors. In other words, an artificial neural network may be constructed by using the plurality of the frames for the multi-dimensional data, only to output the optimal compensating variable.

Specifically, the AI module may output a compensating variable at every preset time intervals. As one example, a compensating variable may be output at every 420 ms. In other words, the compensating variable may be output by using ten input data for 420 ms.

The number and type of the vibration inducting factor and vibration result may be changed. As the number of the factors increases, the more precise result of the expectation may be output.

Basically, the user may be provided with the washing machine having the AI module in which the results of the learning accumulate. The compensating variable may be output based on the current factors in a state where the results of the learning accumulate according to quite diverse spinning environments. However, as more current factors are provided, the current factor values are highly unlike to be equal to the pre-learned factor values. Accordingly, the AI module may output not only the results of the pre-learning but also the results of new learning that is gained consistently performed. Thus, the AI module may repeatedly learn more and output the more precise expectation result.

As mentioned above, the washing machine may communicate with the external server via the communication module 90. The external server may be a server provided by a seller or manufacturer of the washing machine for the user. The result of the learning performed in the washing machine may be transmitted to the external server. In contrast, the result of the learning may be transmitted to the washing machine via the external server. Specifically, the learning result of the same model number washing machine used by another user may be provided via the external server. Accordingly, more various and plentiful learning results may accumulate.

Meanwhile, the request RPM compensation control according to this embodiment may be performed in the entire laundry distribution acceleration section and it is preferred that the request RPM compensation control is performed only in some area of the laundry distribution acceleration section. Specifically, it may be performed until the drum RPM reaches a target RPM of the laundry distribution acceleration section.

As one example, when the laundry distribution acceleration section is performed between 60 RPM and 108 RPM, the request RPM compensation control may be performed only in a section from 60 RPM near 90 RPM.

Here, approximately 90 RPM may be a little bit lower than the RPM at which the complete spin drive is performed. Until reaching approximately 90 RPM, some of the laundry may rise and fall to perform the laundry distribution. However, the laundry distribution may not be substantially performed in a section near 108 RPM where the complete spin drive starts.

A meaningless learning section may be omitted by focusing the request RPM compensation control section (A section). In other words, selection and concentration may be effectively performed by the request RPM compensation control. Here, a corresponding RPM to a start point of A section could rise a little bit. Accordingly, A section may be some area of the laundry distribution acceleration section (a second acceleration step) in any cases.

Figure 6:
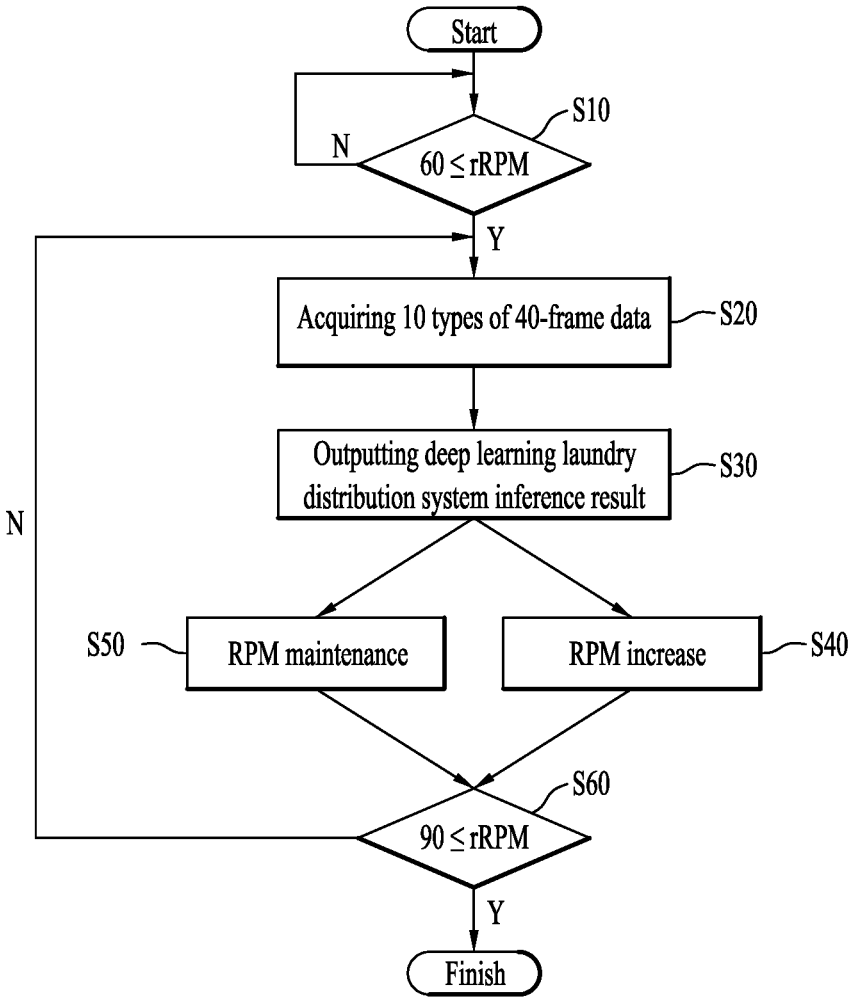
FIG. 6 is a flowchart illustrating the request RPM compensation control flow in the washing machine according to one embodiment.

Hereinafter, referring to FIG. 6, the request RPM compensation control according to this embodiment will be described in detail.

Upon performing the spin cycle, it is determined whether a start condition of the request RPM compensation control is satisfied S10. In other words, it is determined whether to reach the laundry distribution acceleration section. Upon entering the laundry distribution acceleration section, it is determined whether to enter the request RPM compensation control section.

Once a start RPM of the request RPM compensation control section is satisfied, the AI module acquires forty frame data for ten types of factors, for example. In other words, forty frame data for ten types of factors may be input to the AI module via the motor control module or the processor in time-series S20.

The AI module may output the result of the deep learning laundry distribution inference based on the input data, in other words, output the compensating variable S30.

The processor may process the request RPM in the laundry distribution acceleration section by reflecting the output compensating variable and transmit the processed RPM to the motor control module.

Accordingly, the motor control module may process the request RPM by reflecting the compensating variable and control the drum RPM. As one example, the RPM increase S40 and the RPM maintaining S50 may be performed and the RPM decrease not shown in the drawings may be also performed.

The preset request RPM is changed based on the compensating variable expected by reflecting the current factors. In other words, the request RPM may repeat rising, maintaining and decelerating. However, such the request RPM compensation control may be performed in a direction in which the drum RPM rises as time passes macroscopically. The laundry distribution may be promoted by compensating the request RPM microscopically such that the future vibration occurrence can be dealt with proactively. Saying in easy terms, upon expecting the future over-vibration, the drum RPM is lowered. Upon expecting no future over-vibration, the drum RPM may be raised.

Meanwhile, the request RPM in the request RPM compensation control section may be preset to have a fixed rising gradient. The RPM rising gradient may mean that the request RPM is charged or modified by reflecting and processing the compensating variable.

At this time, it is preferred that an absolute value of the rising or falling gradient of the compensated request RPM is much larger than an absolute value of the fixed rising gradient. The rising or falling gradient for the compensating variable may be set different. It is preferred that an absolute value of the maximum gradient is larger than an absolute value of the fixed rising gradient so as to improve the effect of the laundry distribution effect by the instant and active compensation control.

In the request RPM compensation control section, data acquisition S20, compensating variable output S30, compensation variable output S30 and request RPM compensation control S40 and S50 may be repeatedly performed until reaching a preset RPM. Upon reaching the preset RPM, such the compensation control performing may be stopped and the next spin cycle may be performed. In other words, the request RPM compensation control may be performed until the drum RPM reaches an end RPM of the request RPM compensation control section.

In other words, upon reaching approximately 90 RPM, the compensation control performing is paused and the drum RPM rises more to accelerate to 108 RPM. After that, there may be sequentially performed spin drive containing, stable spinning acceleration section performing, stable spinning section performing, and entry into the main-spinning and main-spinning performing.

Figure 7:
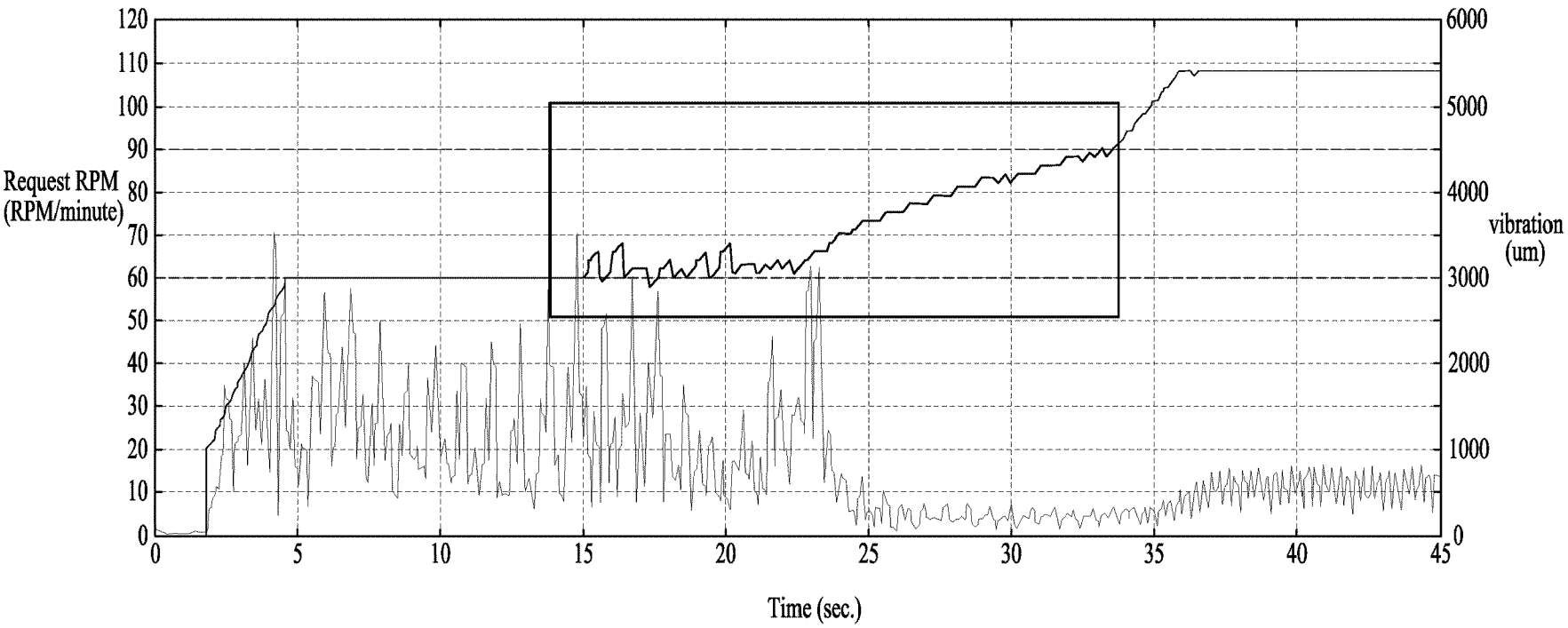
FIG. 7 is a graph illustrating request RPM changes and vibration value changes in a dry-spin cycle, once the request RPM compensation control shown in FIG. 6 is performed.
Figure 8:
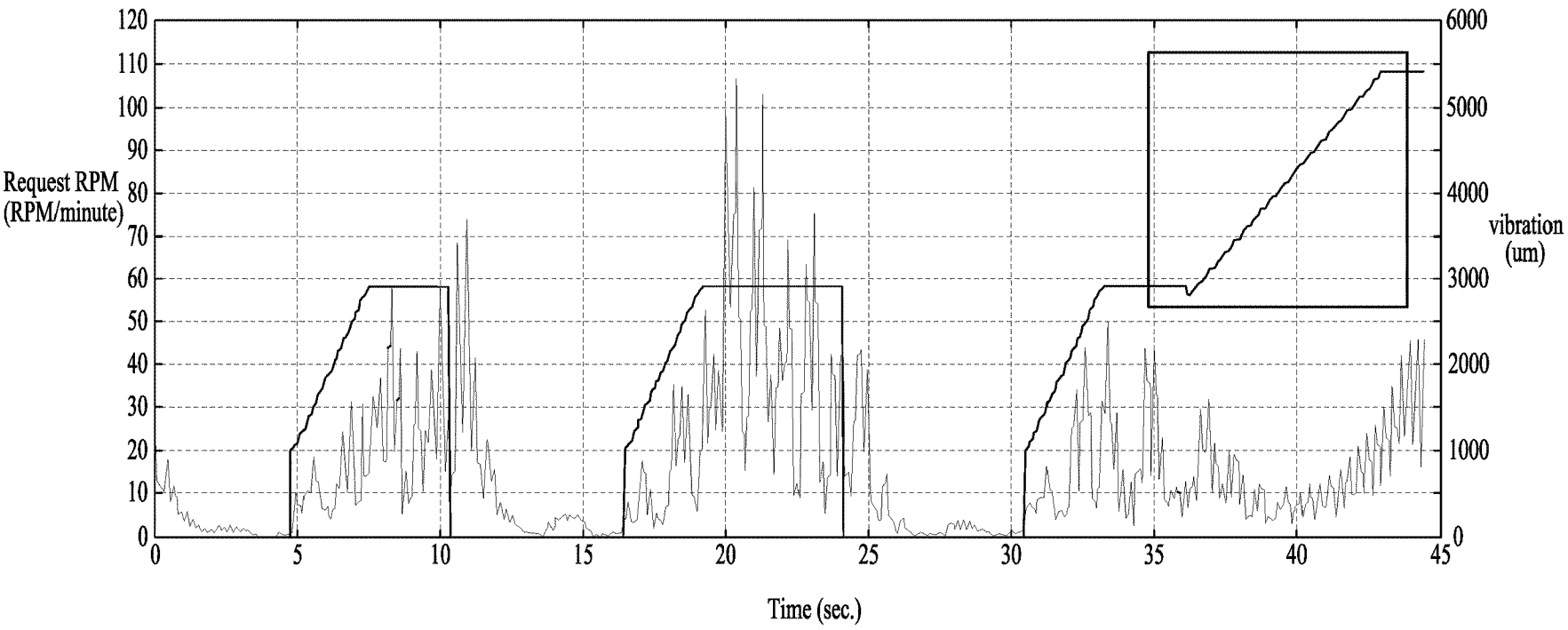
FIG. 8 is a graph illustrating one example of request RPM changes and vibration value changes in the conventional dry-spin cycle.

Referring to FIGS. 7 and 8, one example of performing the compensation control under the same spinning condition will be intuitively compared with the conventional case.

Until the spin maintaining section starts upon passing 45 seconds after the spin cycle starts, a difference between the request RPM and the vibration value is clearly shown in this embodiment and the conventional spinning logic.

As shown in FIG. 8, the tumbling drive is performed in the conventional washing machine upon starting the spinning process and the entry into the main-spinning is then tried in earnest. Hence, the spin maintenance section is entered in approximately 43 seconds. Until entering into the spin maintenance section, the vibration value gradually rises and then it is more likely to fail to enter into the main-spinning. That is because it cannot be guaranteed that the laundry distribution is effectively formed in the former tumbling sections.

Especially, in the laundry acceleration section of the conventional spin-cycle as shown as a box, the request RPM is fixed (strictly saying, a fixed gradient) for a preset time period and the vibration value even rises. Accordingly, it is more likely that such the laundry distribution acceleration section is repeatedly performed.

As shown in FIG. 7, it may be omitted in this embodiment that the tumbling section is repeated several times. In other words, the laundry distribution acceleration section may be performed continuously after one tumbling section is performed.

The laundry distribution acceleration section may be performed upon sensing the RPM at which the laundry distribution acceleration section is entered into and the request RPM compensation control may be performed. As shown in FIG. 7, the compensating variable is reflected and the request RPM changes may be relatively large in an initial stage of the laundry distribution acceleration section. Through such a process, the laundry distribution may be effectively performed. The request RPM compensation control may be consistently performed by reflecting the compensating variable that is output after that.

More specifically, it is known that the relation between the RPM increase and the vibration value is not typified. The current compensated request RPM may not reflect the current vibration value but correspond to the expected vibration value.

The request RPM rises from a middle area of the laundry distribution acceleration section shown as the box. At this time, the vibration value is relatively high. It can be understood that the result of the learning that the rise of the request RPM lowers the future vibration vale is reflected.

The compensation control may be performed unit approximately 90 RPM before reaching a laundry distribution acceleration section target RPM and raise the RPM at a preset gradient. After that, the laundry distribution acceleration section may finish.

Compared with the section indicated as the box shown in FIGS. 7 and 8, it takes a relatively long time to perform the laundry distribution acceleration section in this embodiment. However, the tumbling performed several times may be omitted such that it can enter into the spinning maintenance section earlier. Also, the vibration values generated in the laundry distribution acceleration section and the spinning maintenance section may be remarkably lowered in this embodiment. That is, it can be said that the laundry distribution is actively performed in the laundry distribution acceleration section. Also, such a difference between the vibration values may have a close relation with a main-spinning entry success rate which will be descried later.

According to this embodiment, the vibration value of the spinning section is relatively so small to raise the success rate of the entry into the main-spinning. In contrast, according to the conventional control, the vibration value is relatively so large to lower the success rate of the entry into the main-spinning. Accordingly, the try to enter into the main-spinning has to be additionally made in the conventional washing machine such that the overall spinning time may have to be increased.

In addition, an average of the vibration values during the dry-spin cycle in this embodiment is very different from an average in the control of the conventional washing machine. That means that there is a noticeable difference between spinning noise and vibration reduction and even durability of the washing machine according to this embodiment and those of the conventional washing machine.

The embodiment configured to improve the spinning performance by proactively performing the laundry is described above. Such the embodiment may be realized independently or combined with following embodiments.

Upon entering into the spinning maintenance section, the drum RPM is accelerated to a middle RPM before reaching a final spinning RPM. The drum may be constantly rotated at the middle RPM for a preset time period. The middle RPM may be 350 RPM as one example as mentioned above. At this time, this middle RPM is a middle RPM right before entering into the main-spinning RPM, different from the other middle RPMs such that it may be a middle spinning RPM.

The spin RPM maintenance drive section, the acceleration section from the spin RPM to the middle spinning RPM and the middle spinning RPM maintenance drive section are very important. If over-vibration occurs in those sections, the entry into the main-spinning is not allowed. Especially, it can be said that the middle-spin RPM acceleration section is more important. In other words, when the RPM is accelerated to enter into the main-spinning, strong vibration might be amplified enough to damage or break the washing machine. Unless over-vibration occurs in the sections, the entry into the main-spinning and the main-spinning section may be stably performed.

The spinning algorithm generally includes the spin RPM maintenance drive section, the middle-spin RPM maintenance drive section and the acceleration section performed between the other two sections. At this time, when over-vibration occurs, the drum rotation will be paused and the former sections may be re-performed to try to enter into the main-spinning. In other words, the spinning logic configured to deal with the future over-vibration if it occurs may be realized.

In the spinning logic according to this embodiment, a vibration expectation section may be preset and over-vibration occurrence may be expected in the vibration expectation section to deal with the over-vibration. In other words, the future over-vibration may be dealt with in advance, not the over-vibration after it occurs.

Here, the vibration expectation section may be equal to or belong to the acceleration section from the spin RPM to the middle-spin RPM. Also, the vibration expectation section may include a spin RPM maintenance drive section and a middle-spin RPM maintenance drive section.

Figure 9:
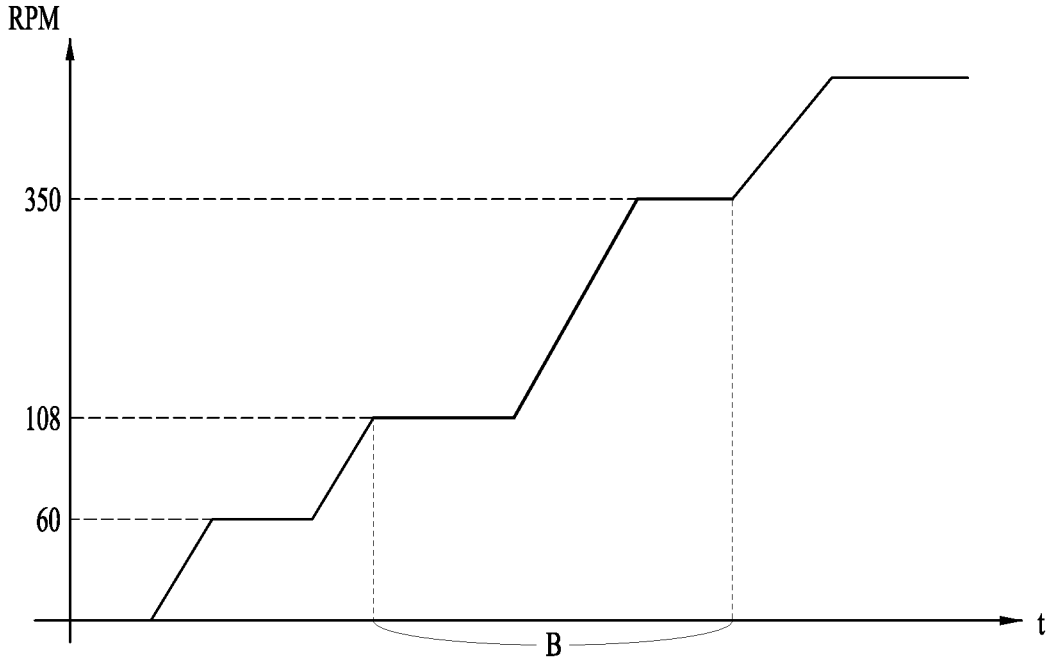
FIG. 9 is a graph illustrating a vibration expectation section in a spinning process to deal with the occurrence of over-vibration when a main-spinning is entered or while the main-spinning is performed in the washing machine according to one embodiment.

As one example as shown in FIG. 9, the vibration expectation section (B section) is from a start point of the spin RPM maintenance drive section to a finish point of the middle-spin RPM maintenance drive section.

The vibration expectation section may expect whether over-vibration will occur before raise the RPM in real time. In other words, it may be expected whether over-vibration will occur in a preset time after the current time. The result of such expectation may be output as the compensating variable and the RPM may be controlled by reflecting the compensating variable. Accordingly, the compensating variable output and the request compensation control which reflects the compensating variable may be equal to corresponding ones of the above-noted embodiment.

In addition, the input data input to the AI module to output the compensating variable and the AI learning process or logic may be equal to the corresponding ones of the above-noted embodiment. The input and the learned output data are provided and modeled to output the new data that is precisely expected, which may be equal to corresponding ones of the above-embodiment.

According to this embodiment, the future over-vibration may be dealt with before over-vibration occurs and the time when the drum is meaninglessly rotated from the current time to the over-vibration occurrence time may be omitted. Accordingly, it may be possible to realize the vibration expectation system configured to allow no over-vibration while effectively reducing the spinning time.

According to this embodiment, a RPM band is divided in the vibration expectation section and a threshold critical preset to shut off vibration according to characteristics of the divided RPM band may be changed to optimize the spinning vibration and the entry time.

Different from the above-noted embodiment, two results may be output in this embodiment, not the one result. In other words, the two results of learning may be output. For that, two different types of machine learnings or deep learnings may be performed. Specifically, two different learning types are performed simultaneously or in parallel such that different results can be output.

Classification learning and regression learning are well known in the artificial intelligence and detailed description thereof will be omitted accordingly.

First of all, the vibration expectation enabled by the classification learning may be relatively proper to future vibration. However, it may have a low accuracy, compared with the vibration expectation enabled by the regression learning. The vibration expectation enabled by the regression learning may be proper to a relatively near future vibration and have a higher accuracy of vibration expectation.

Hereinafter, referring to FIG. 10, a control method of the vibration expectation section will be described in detail.

Upon entering into the dry-spin cycle, the AI module may consistently receive input values. It may be different whether to perform output corresponding to the input values or control by reflecting the output.

As one example, a step for acquiring ten kinds of data S110 may be performed to transmit such ten kinds of data to the AI module. The step for acquiring the ten kinds of the data may be consistently performed. Upon entering into the dry-spin cycle, the acquired ten kinds of the data may become different. While repeating the data acquisition, it may be determined whether to enter into the vibration expectation section S120.

Specifically, when satisfying a vibration expectation section entry condition, the AI module may output the result of the vibration expectation inference, in other words, the compensating variable. At this time, the inference result gained by the classification learning and the inference result gained by the regression learning may be output.

Here, the vibration expectation entry condition may be specific RPM, more specifically, a current substantial drum RPM. As one example, it may be 108 RPM corresponding to the spin RPM.

Upon entering into the vibration expectation section, the compensation control may be performed to reflect the inference result consistently and repeatedly. At this time, the inference result may mean whether the entry into the main-spinning is failed by future over-vibration. When outputting the inference result that the entry into the main-spinning will be succeeded, the drum RPM may be controlled according to the preset logic. When the inference result is output that the further entry into the main-spinning will be failed, the drum may be paused in advance S180.

In other words, the compensation control may not be performed corresponding to the inference result of the main-spinning entry success, and the compensation control for pausing the drum proactively may be performed corresponding to the inference result of the main-spinning entry success.

As the vibration expectation section consistently deducts the inference result of the main-spinning entry success is deducted upon raising the drum RPM, the vibration expectation may finish. The vibration expectation section may finish when the drum RPM reaches a preset RPM or the middle-spin RPM. Accordingly, when it is determined that the current RPM is equal to or higher than the vibration expectation section finish RPM S160, the vibration expectation section may finish. After that, the drum RPM is accelerated to the main-spinning RPM and the main-spinning is performed at the main-spinning RPM.

The inference result may be a value indicating probability and determining whether to continuously perform even the main-spinning by maintaining the current spinning logic or restart the spinning logic by pausing the drum rotation. Accordingly, the inference result is highly unlikely the entry into the main-spinning is a 100% success or a 100% failure extremely. A critical value preset to determine to maintain or restart the spinning logic may be provided. As one example, when the output result is corresponding to a 60% or more success rate of the entry into the main-spinning, the spinning logic may be maintained. When the output result is corresponding to less than 60% success rate, the spinning logic may restart.

In this instance, the critical value or the vibration shut-off threshold value may be set different according to a RPM band. The critical value may be increased in a low RPM band and decreased in a high RPM band. In other words, the inference result is compared with the critical value and the logic maintenance or restart may be determined based on the result of the comparison. It is possible to set the critical value differently according to the RPM band.

Figure 10:
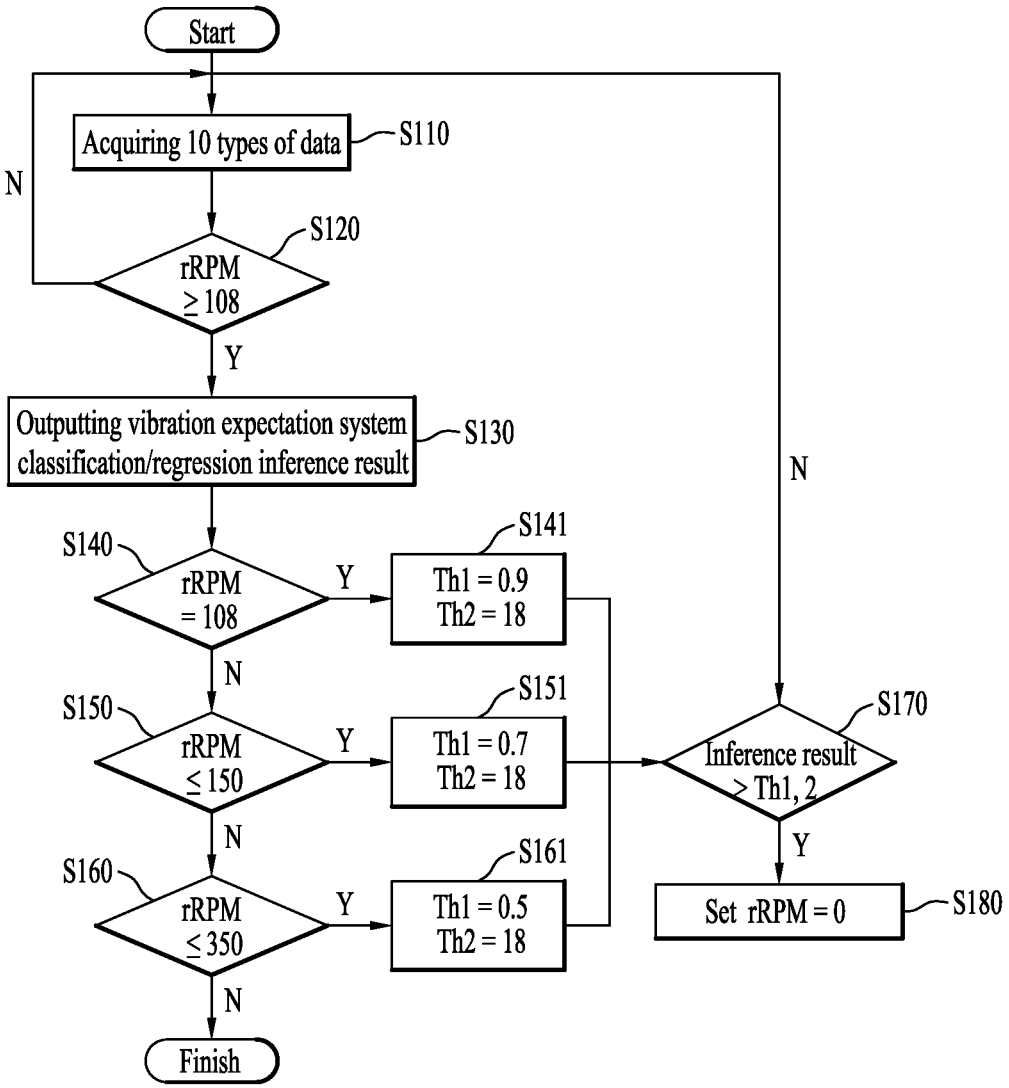
FIG. 10 is a flowchart of control in the vibration expectation section in the washing machine according to one embodiment.

FIG. 10 illustrates one example that the RPM band is divided into three steps and different critical values are set for the respective three steps. When the inference result is larger than each critical value, it is determined that the main-spinning success rate is high and the spinning logic is maintained. When the inference result is the critical value or less, the drum rotation is paused and the spinning logic may restart.

As mentioned above, the inference result may be deducted by processing the two learning models simultaneously. A first critical value may be the result output by the classification learning and a second critical value may be the result output by the regression learning.

The critical values of the regression learning result may be equal even if the RPM band becomes different, because it is proper to short range expectation and has a high accuracy of vibration expectation. In contrast, the critical value of the classification learning result may be different as the RPM band becomes different. In other words, as the RPM band becomes high, the drum RPM becomes closer to the main-spinning RPM such that it may be preferred that the critical value may be preset more strictly.

Specifically, a loose critical value is preset in the low RPM band and a more strict critical value is preset in a high RPM band.

As one example, a following spinning process may be performed only when the probability of the future over-vibration is very low by applying a critical value 1 in the lowest RPM band, in other words, only when the main-spinning entry success rate. As the RPM band is increased more, the drum RPM may become closer to the main-spinning, it is preferred that a critical value 1 becomes low.

The critical value change for each band may reflect the result output by the classification learning that is proper to the long range expectation. However, the reflection of the result output by the classification learning that is proper to the short range expectation may reflect the same critical value or relatively small part of the critical difference.

As one example, the regression learning result may be proper to the short range expectation. Accordingly, the critical value for the compensating variable that represents the probability of the near future over-vibration with respect to the current time may be equal to what is shown in FIG. 10.

When the two outputs are generated according to the results of the two different learnings, the critical values for the result of the regression learning that is proper to the short range expectation may be set equal, regardless of the RPM band. The critical values may be strictly set to stably allow no over-vibration.

In contrast, the critical value for the result of the classification learning that is proper to the long range expectation may be set loose as the drum RPM rises, in other words, becomes closer to the main-spinning.

Accordingly, in this embodiment, the expectation results for the far future and the near future may be used simultaneously such that the more reliable dry-spin cycle may be provided. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims. Therefore all changes and modifications that fall within the metes and bounds of the claims, or equivalents of such metes and bounds, are therefore intended to be embraced by the appended claims.

What is claimed is:

1. A washing machine comprising:

a case that defines an exterior of the washing machine;

a tub provided in the case and configured to hold wash water;

a drum rotatably mounted in the tub and configured to accommodate laundry;

a vibration sensor provided in the tub and configured to sense vibration of the tub and to output a vibration value of the tub as a current vibration result factor;

a motor configured to drive the drum to process the laundry;

a motor controller configured to control a revolution per minute (RPM) of the drum according to a request RPM by controlling a current value applied to the motor, the motor controller being configured to provide a current vibration inducing factor;

an artificial intelligence (AI) module configured to receive input of the current vibration result factor and the current vibration inducing factor and to output a compensating variable at a preset time interval for proactively reducing future vibration of the tub that is expected based on a current laundry distribution state within the drum, the AI module comprising one or more artificial neural networks; and a processor configured to perform a dry-spin cycle through a centrifugal power of the drum and to control the RPM of the motor through the motor controller by compensating the request RPM based on the compensating variable, wherein the motor controller is configured to control the motor according to control of the processor.

2. The washing machine of claim 1, wherein the dry-spin cycle comprises an acceleration section in which the RPM of the drum is accelerated from a tumbling RPM to a spin RPM for distributing the laundry, and wherein the processor is configured to adjust the request RPM in the acceleration section based on the compensating variable.

3. The washing machine of claim 2, wherein the dry-spin cycle comprises:

a tumbling maintenance section in which the RPM of the drum is maintained at the tumbling RPM before the acceleration section is performed; and a spin RPM maintenance section in which the RPM of the drum is accelerated to the spin RPM after the acceleration section.

4. The washing machine of claim 3, wherein the dry-spin cycle includes only one of the tumbling maintenance section such that the drum does not repeat tumbling and pausing after the dry-spin cycle starts.

5. The washing machine of claim 4, wherein the processor is configured to, in the dry-spin cycle, start the tumbling maintenance section based on the RPM of the drum reaching the tumbling RPM after starting the dry-spin cycle.

6. The washing machine of claim 3, wherein the tumbling RPM is preset as about 60 RPM and the spin RPM is preset as about 108 RPM.

7. The washing machine of claim 3, wherein the processor is configured to compensate the request RPM based on the compensating variable output at the preset time interval until the RPM of the drum reaches a predetermined RPM that is lower than a final target RPM of the acceleration section.

8. The washing machine of claim 7, wherein the predetermined RPM is about 90 RPM in the acceleration section.

9. The washing machine of claim 1, wherein the compensating variable corresponds to one of maintenance of the RPM of the drum, an acceleration of the RPM of the drum, or a deceleration of the RPM of the drum.

10. The washing machine of claim 9, wherein an absolute value of a maximum value of the acceleration or the deceleration of the RPM of the drum compensated by the compensating variable is larger than an absolute value of a basic acceleration maximum value set for an acceleration section of the dry-spin cycle.

11. The washing machine of claim 1, wherein the request RPM is compensated to control the RPM of the drum in real time.

12. The washing machine of claim 1, wherein the AI module is configured to learn whether over-vibration occurs based on the current vibration result factor, the current vibration inducing factor, and the request RPM compensated by the compensating variable.

13. The washing machine of claim 12, wherein the AI module is configured to perform learning to update the compensating variable based on another input of the current vibration result factor and the current vibration inducing factor.

14. The washing machine of claim 12, wherein the AI module comprises a deep neural network configured to perform deep learning.

15. The washing machine of claim 12, further comprising:

a transceiver configured to be communication-connected with an external server and to enable the compensating variable of the AI module to be updated via the external server.

16. The washing machine of claim 1, further comprising:

a gyro-sensor configured to sense and output a 3-axis linear displacement and a 3-axis angular displacement that are generated by vibration that occurs by rotation of the drum, wherein the current vibration result factor further comprises an output value from the gyro-sensor.

17. The washing machine of claim 16, wherein the gyro-sensor is provided in an outer area of the tub.

18. The washing machine of claim 17, wherein the gyro-sensor is provided in an upper end of the tub.

19. The washing machine of claim 16, wherein the gyro-sensor is located in a horizontal center with respect to a front area of the tub.

* * * * *